US005536368A

United States Patent [19]

Mäkelä et al.

[11] Patent Number: 5,536,368

[45] Date of Patent: Jul. 16, 1996

[54] METHOD AND APPARATUS FOR MIXING A FIRST MEDIUM TO A SECOND MEDIUM AND A BLEACHING PROCESS APPLYING SAID METHOD

[75] Inventors: Mika P. Mäkelä, Huutjärvi; Toivo Niskanen, Hamina; Kari Peltonen, Kotka, all of Finland

[73] Assignee: A. Ahlstrom Corporation, Noormarkku, Finland

[21] Appl. No.: 211,793

[22] PCT Filed: Oct. 16, 1992

[86] PCT No.: PCT/FI92/00276

§ 371 Date: May 2, 1994

§ 102(e) Date: May 2, 1994

[87] PCT Pub. No.: WO93/07961

PCT Pub. Date: Apr. 29, 1993

[30] Foreign Application Priority Data

Oct. 18, 1991 [FI] Finland ..... 914922

[51] Int. Cl.[6] ..... B01F 7/00; D21C 9/10; D21C 9/153

[52] U.S. Cl. ..... 162/63; 162/57; 162/52; 261/86; 366/279; 366/262

[58] Field of Search ..... 162/63, 57, 52; 366/279, 262, 263, 270; 137/625.41; 261/24, 28, 80, 81, 82, 83, 84, 85, 86

[56] References Cited

U.S. PATENT DOCUMENTS

| | | | |
|---|---|---|---|
| 2,272,573 | 4/1939 | Messmore | 366/263 |
| 2,772,863 | 12/1956 | Harney et al. | 366/262 |
| 3,048,376 | 4/1958 | Howald et al. | 366/262 |
| 4,435,085 | 3/1984 | Luthi et al. | 366/155 |
| 4,594,152 | 6/1986 | Gullichsen | 209/273 |
| 5,064,093 | 6/1978 | Richter | 162/17 |
| 5,279,709 | 11/1991 | Niskanen | 162/52 |

*Primary Examiner*—Donald E. Czaja
*Assistant Examiner*—Jose A. Fortuna
*Attorney, Agent, or Firm*—Nixon & Vanderhye

[57] ABSTRACT

The present invention relates to a mixing of gas into a medium. The method and apparatus in accordance with the present invention are especially applicable in the bleaching plants of the wood processing industry for mixing gaseous bleaching chemicals into pulp and to bleaching process of pulp, in which the mixing method and apparatus in accordance with the present invention are applied. An excellent application is mixing ozone-containing gas into a fiber suspension flowing in a pipe line and an ozone bleaching process. The previously known methods and apparatuses have not been able to mix satisfactorily large volumes of gas, about 50% of the total volume of the flow, into the medium flow. In the method in accordance with the present invention the mixing is carried out in a strong shear force field efficiently and uniformly, whereafter the fiber network of the medium is allowed to form rapidly and in a controlled manner so that gas is not allowed to separate in the flow as bubbles, but remains in the plug flow in the fiber network.

33 Claims, 9 Drawing Sheets

METHOD AND APPARATUS FOR MIXING A FIRST MEDIUM TO A SECOND MEDIUM AND A BLEACHING PROCESS APPLYING SAID METHOD

BACKGROUND AND SUMMARY OF THE INVENTION

The present invention relates to mixing a first medium into a second medium. The present invention especially relates to mixing gas to a medium, but it may as well be applied, for example, for mixing liquids, since mixing of gas has considerably higher requirements than the others both on the mixers and mixing methods. The method and apparatus in accordance with the present invention are especially suitable for mixing gaseous bleaching chemicals, such as oxygen or ozone, used in the bleach plants of the wood processing industry, and for the pulp bleaching process applying the mixing method and apparatus in accordance with the present invention. An excellent application is mixing ozone-containing gas with fiber suspension flowing in a pipe and an ozone bleaching process.

The main objective of the present invention is to develop a method of and an apparatus for mixing large volumes of gas into a medium. Further, since the chemical to be added may be extremely rapidly reacting, such as ozone, said preconditions set great demands on the method and apparatus to be developped.

In most of the modern bleaching plants very often large volumes of gas are desired to be mixed into a medium consistency fiber suspension, which means that the consistency of the fiber suspension is approximately 10–18% and it must be possible to mix a large volume of gas therewith. In other words during the mixing process approximately 40 to 80% of the medium is fiber suspension and approximately 20 to 60% gas, the proportion of the gas most usually being approximately 30 to 50%. It is difficult to have a uniform feed of such a large gas volume and to reach a good mixing result, because gas is separated due to local pressure differences to areas of lower pressure, if possible. The non-uniform mixing results on the increase of chemical loss, which further results in a non-uniform bleaching and in poorer runnability of the process.

The use of above mentioned ozone as a bleaching chemical in bleaching will become more and more popular in the future. There is an ongoing transition from pilot testing to applications in a mill scale, which leads to even higher demands on the apparatus due to the characteristic behavior of ozone. Ozone may be produced and used with the modern technique only in very small proportions, whereby most (usually more than 90%) of the chemical to be mixed with the pulp to be bleached is in fact inert carrier gas compared with the ozone. The result is, of course, that the volume of the gas to be mixed is large. Another significant point is that ozone reacts very rapidly with the material in the fiber suspension. Thus the mixing must be at the same time both very quick, efficient and also uniform in result. Since the ozone immediately reacts with all fibrous material it encounters, the ozone-containing gas may not be allowed to meet only a particular portion of a suspension for a single moment, because it will result in a very uneven bleaching. According to the present technology ozone is not at all a selective chemical and it reacts equally efficiently both with the fibrous material and the lignin to be removed or bleached. In other words, if the ozone dosing for a portion of the suspension is excessive, the ozone quickly causes damage also in the suspension, resulting, of course, in poorer quality of the bleached pulp. Thus the mixing must be very uniform right from the beginning. Due to the non-selectivity the ozone cannot also not be overdosed and also not for the reason that ozone is an expensive chemical.

Ozone may be industrially produced only in relatively dilute mixtures. In other words only 5 to 10% of the gas to be fed for the bleaching, is ozone the rest operating merely as a so called carrier gas. The carrier gas is in most cases either oxygen or nitrogen. Therefore, approximately 10 to 20 times the volume of the ozone carrier gas must be fed and mixed although relatively small volumes of ozone are otherwise sufficient for the bleaching.

Some prior art mixers in the use of cellulose industry as well as their applicability in efficient and uniform mixing of large volumes of gas are studied more in detail below.

U.S. Pat. No. 4,416,548 illustrates an embodiment, in which the gas to be mixed is introduced into the frontside of a cylindrical rotor of an apparatus slightly resembling a centrifugal pump to a point where the pulp flowing axially along the suction duct is divided fan-like into a radial flow bringing the gas therewith to the rim of the cylindrical rotor. The flow turns there again axial, flowing, for example, between the pin-like members stationary mounted on the rotor housing and on the outer rim of the rotor to a spiral discharge chamber of the apparatus. The operation of the apparatus is based on that the pin-like members of the rotor pass the members of the housing very close generating a very strong shear force field mixing the chemical effectively to the pulp. The apparatus has two significant defects or disadvantages considering the purpose of the present invention. Firstly, the gas is fed into the center of the rotor into the relatively slowly flowing pulp, which, for example, when feeding ozone, results in a local overdose and damage of cellulose in the particular portion of the pulp. In order to be able to bleach the whole pulp amount, some kind of an overdose should be fed into the mixer, even with a risk of damaging the cellulose. Secondly, there is the disadvantage that subsequent to the efficient "pin mixing zone", pulp is allowed to be quickly discharged into a wider space, a spiral. Consequently, a zone of lower pressure is generated, in which the gas in the pulp is easily separated by the centrifugal force from the fiber suspension, which is still in a fluidized stage. Thus when the consistency of the pulp increases and the pulp forms a plug flow in the discharge channel gas is entrained therewith in large bubbles. As a result therefrom the ozone which possibly still has not reacted in the gas would still react only with the fibers defining the gas bubbles.

FI patent 76132 illustrates a construction which to some extent resembles the arrangement in accordance with the U.S. publication. The apparatus, however, is evidently a centrifugal pump, the impeller vanes of which are arranged two-piece in such a way that it is possible to fit a number of feed and mixing pins for the chemicals between said parts. Thus the feed of chemicals to a strong field of shear forces, is carried out in an orthodox manner but the pulp is discharged from the mixing zone to the spiral of the centrifugal pump, in which the pulp is, as known, subjected to intense centrifugal forces, due to which gas is separated from the pulp to form its own layer. The result is the same as above.

As a third example of the prior art is an arrangement disclosed in U.S. Pat. No. 4,305,894 comprising an axial flow pump, a rotor thereof and mixing means for gas. The liquid, with which the gas is intended to be mixed, is drawn by the rotor to a cylindrical suction duct, into which gas is fed immediately after the rotor in the flow direction through a pipe surrounding the axis of the rotor. A stationary blade is mounted on the outer surface of the pipe immediately after said gas feed to generate together with a liquid, strongly circulating in the duct, a field of shear forces in the liquid so that gas is mixed with the liquid. Additional efficiency to the mixing may be brought about by adding ribs or like on the wall. The apparatus does not, however, guarantee a uniform mixing, because the diameter of the suction duct is rather large and the gas is fed into the center of the flow. It is not possible to ensure that the gas in the apparatus would be able to flow into contact also with the liquid flowing on the outermost layer of the flow, but it is assumed that the gas is mixed with the liquid flowing relatively close to the axis and the liquid in the outermost area of the suction duct remains without gas. When ozone is used, the non-uniform mixing results in non-uniform bleaching result and damage of cellulose because of a local overdose.

A fourth prior art publication worth mentioning is DE 2920337, which generally describes the utilization of the fluidization and different applications thereof, giving an example of mixing liquid or gas into fiber suspension. Said embodiment is illustrated primarily in FIGS. 1–4, of which the construction of FIG. 2 comprises a cylindrical rotor positioned substantially axially in the flow channel, the outer surface of the rotor as well as the inner wall of the flow channel being provided with protrusions. The chemical, gas or liquid, to be mixed is introduced into the rotor through the shaft of the rotor, from the surface of which the chemical is fed to a relatively narrow fluidization zone between the rotor and the wall of the flow channel. It may be assumed of said construction that the mixing of gas into the suspension is uniform, but said apparatus still has some significant defects. Firstly, the illustrated rotor is rather short, which as such is an orthodox arrangement considering the energy consumption and also when the volume of the gas to be mixed is not very great or when the intention is to give no time to the chemical to react with the suspension. However, what is obtained with the mixer described above is a relatively high circumferential speed of the suspension causing the separation of the gas in the area immediately subsequent to the rotor when centrifugal force forces the suspension to the wall of the flow channel and the gas flows to the center of the flow. Said separation tendency in the arrangement according to the publication is so strong also because the axial cross-section of the rotor is rectangular, whereby the pulp being discharged from a rather narrow fluidization zone arrives to a large flow channel. There a local zone with a strong low-pressure effect (i.e. a big pressure difference) is generated and thus gas can readily separate as large bubbles to the center of the flow.

A second embodiment illustrated in DE publication 2920337 (FIGS. 3 and 4) comprises a similar rotor, which is mounted to the flow channel transversely in such a way that the suspension must pass through a narrow gap to the backside of the mixer rotor, where a throttling point of the flow channel is arranged. The mixing process corresponds to the previous embodiment, but is shorter of its duration. The problem is that the suspension is allowed to be discharged from the narrow fluidization zone into a quickly widening channel, whereby gas is able to separate as large bubbles from the suspension.

SE patent document 462 857 discloses a mixer for mixing bleaching agent with pulp. The pulp is tangentially introduced into the mixer housing within which a rotor rotates. The rotor comprises a substantially radial plate provided at its outer edge with an annular mixing member having ribs or grooves lying in a substantially radial plane. In a corresponding manner the stationary housing portions facing said mixing member lie in a substantially radial plane and are provided with ribs or grooves. The pulp together with the bleaching agent travels radially inwardly through the gap between said mixing means and the housing and is axially discharged from the mixer. A characterizing feature of the mixer of the SE publication is that the pulp is discharged through a narrow annular gap into a wide space to be discharged from the mixer.

As is seen from the prior art review above only few previously known apparatuses are able to mix a gaseous chemical quickly and presumably also relatively uniformly into the fiber suspension. Yet, until now, it has always been mixing of relatively small volumes of gas and/or slowly reacting chemicals into the pulp. Thus it is in a way logical that no arrangements in accordance with the prior art can ensure the mixing of large volumes of gases into the pulp so that the gas would also remain uniformly mixed with the pulp subsequent to the mixing.

The objective of the present invention is to eliminate the disadvantages of the prior art apparatuses and to ensure that also large volumes of gases are uniformly mixed with the pulp and that they remain mixed with the pulp also when the pulp is discharged from the mixer to a flow channel or a reaction vessel.

It is possible to further design the mixing apparatus in accordance with the present invention to be applied for carrying out the actual ozone bleaching in such a way that the carrier gas and the possibly excessive ozone are removed by means of the same apparatus and possibly returned by means of a second mixing apparatus to the next bleaching stage or step, whereby the term "displacement bleaching" may well be used. Said displacement bleaching refers to a bleaching, in which a very rapidly reacting chemical is fed into pulp and mixed with the pulp to be treated in a relatively long axial distance (the distance is, of course, affected by the reaction speed of the chemical). The idea, however, is that, when the untreated pulp reaches the mixer, it is mixed with a certain amount of chemicals (in this example ozone), which immediately reacts, leaving no or hardly any reactive chemical in the gas-pulp mixture, only so called carrier gas. When new chemical mixture is fed in the same mixer and mixed into the pulp it pushes the "old" carrier gas from thereahead, which justifies the use of the term "displacement bleaching".

Characterizing features of the method in accordance with the present invention are

- to feed gas in the first phase into a fluidized medium flow in a narrow mixing channel;
- to dampen the shear force field of the gas-medium-suspension in the second phase and to allow a plug flow to be formed in the medium, whereby the gas remains uniformly distributed in said plug flow.

It is again a characterizing feature of the apparatus in accordance with the present invention that the apparatus comprises a mixer body, an inlet channel for medium, a substantially annular mixing channel, a discharge channel and a rotor rotatable in the mixing channel and that the rotor is tapering in the direction of the flow.

It is a characterizing feature of the bleaching process applying the method in accordance with the present invention

- to feed the bleaching chemical into an annular mixing channel;

to mix the bleaching chemical into a medium which is in a fluidized state;

to further agitate the medium allowing the chemical to react with the medium;

to discharge the medium from the mixing channel to the discharge channel; and to remove residual chemical from the medium in the discharge channel and/or in the end portion of the mixing channel.

The method and apparatus in accordance with the present invention are described more in detail below, by way of example, with reference to the accompanying drawings, in which

DETAILED DESCRIPTION OF THE DRAWINGS

Figure 1:
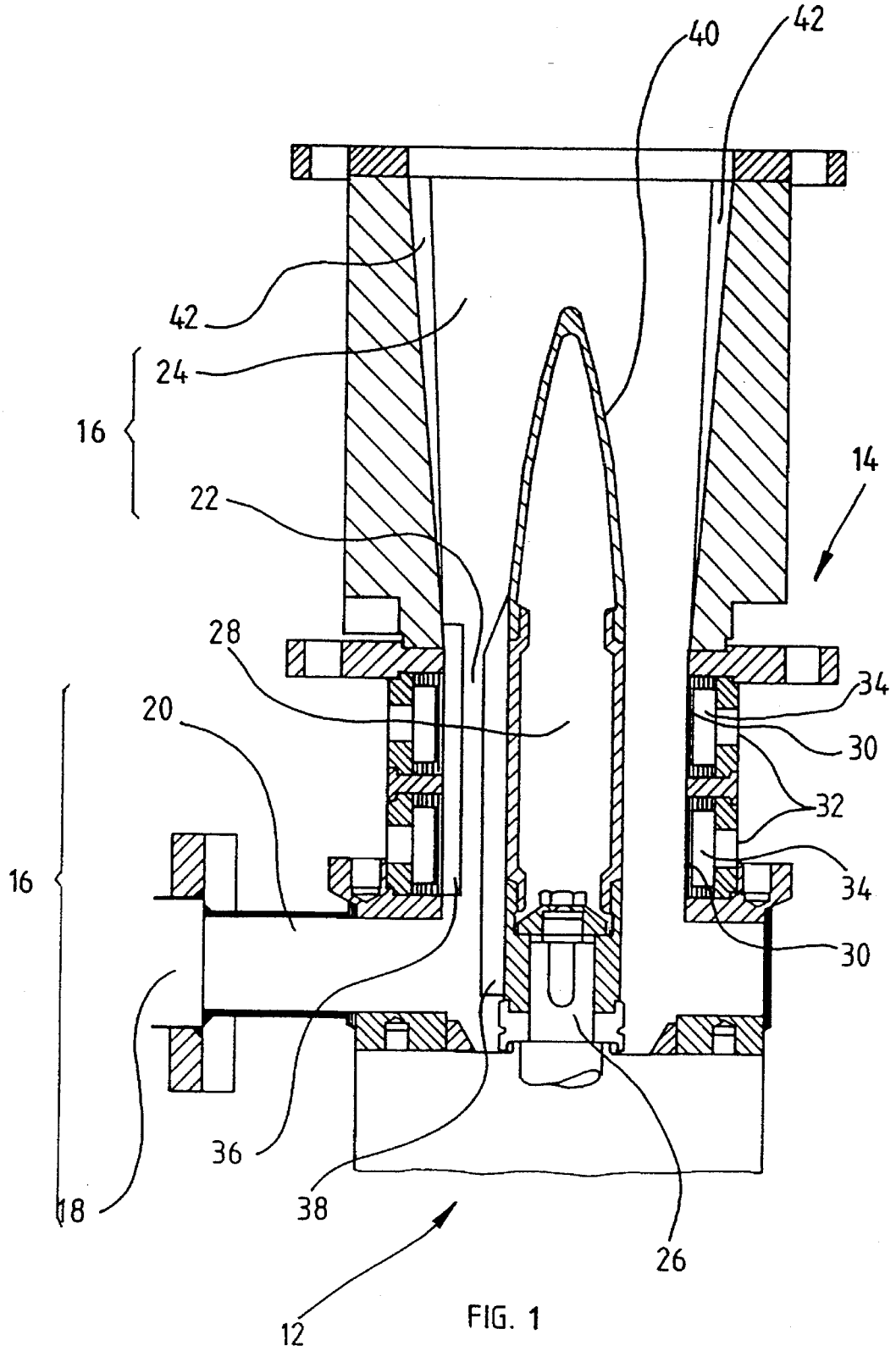
FIG. 1 illustrates an axial sectional view of a preferred embodiment of an apparatus in accordance with the present invention.
Figure 2:
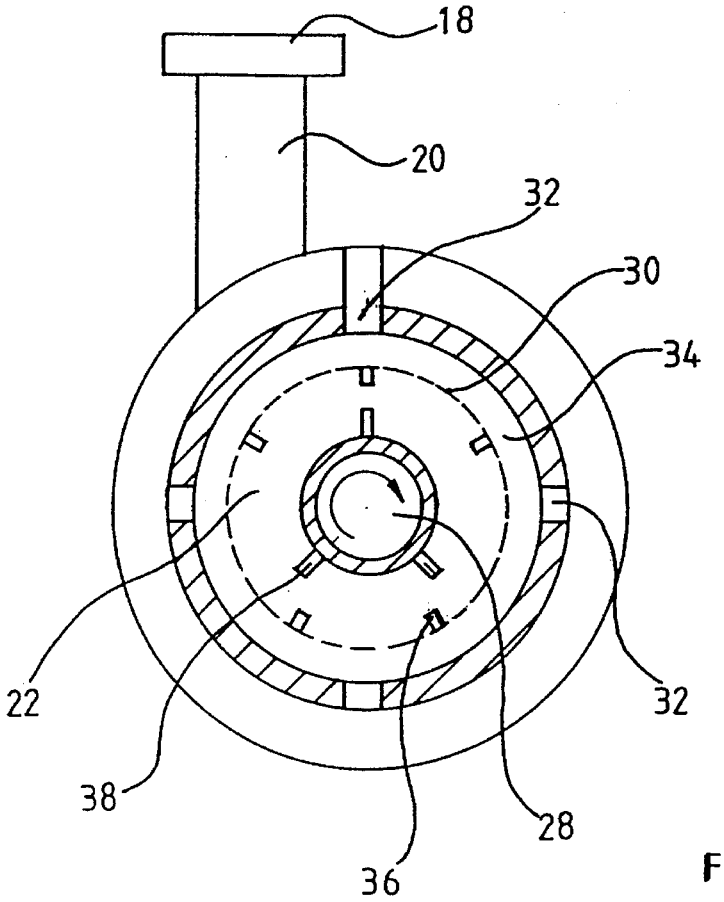
FIG. 2 illustrates a sectional view of an apparatus of FIG. 1 via line A—A.

FIGS. 1 and 2 illustrate a preferred embodiment of an apparatus in accordance with the present invention, comprising bearing, drive and sealing unit 12 and a mixing portion 14. The above mentioned unit 12 may be considered to be of conventional construction, the details of which are neither shown nor described here. The mixing portion 14 comprises a rotor body 16, an inlet opening 18 and inlet channel 20 for pulp both mounted in said body 16, a mixing channel 22, a discharge channel 24 and a shaft 26 connected to the drive unit and a rotor 28 connected to the end thereof. The inlet channel 20 for pulp may be radial, but it may as well be tangential either in the rotational direction of the rotor 28 or preferably feeding pulp against said direction, as particularly pointed out in FIG. 2. The mixing channel 22 is substantially cylindrical, or more accurately annular, and it is surrounded in the embodiments shown in the drawings by two gas feed rings 30 mounted to the rotor body 16, said rings being preferably, for example, of sintered metal, ceramics or even very finely perforated metal plates so that the size of gas bubbles is as small as possible when gas is fed into the pulp. Of course, it is possible for the number of the feed rings 30 to vary from the above mentioned. As can be seen from the drawings, four gas inlet conduits 32 are arranged to the wall of the mixing channel, through which conduits the treating chemical is uniformly fed to an annular chamber 34 outside the feed rings. At least two inlet conduits 32 are preferably required to ensure that the feed of the gas from the ring to the mixing channel is sufficiently uniform, though some applications may function well enough with only one inlet conduit. Preferably, although not necessarily, the walls of the mixing channel are provided with axial ribs 36 in addition to said feed rings 30 to intensify the mixing effect.

The rotor 28 mounted on the shaft 26 is substantially cylindrical in the mixing channel portion and is provided with axial ribs 38 according to the drawing, the purpose of which is to generate such an extensive shear force field together with the ribs 36 possibly mounted on the wall of the mixing channel 22 so that even large volumes of gas are mixed into the pulp uniformly. One substantial requirement for the efficient and economic operation of the rotor is that distance between the walls of the rotor 28 and the mixing channel 22 is not too large or that the distance between the ribs 38 of the rotor 28 and said wall or the ribs 36 arranged according to the drawing on said wall is not very long.

Figure 3:
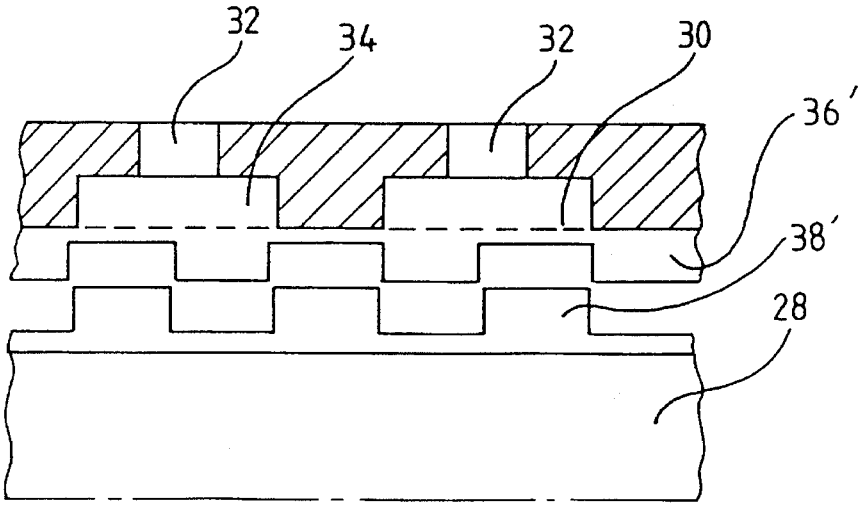
FIG. 3 illustrates a preferred embodiment of the apparatus in accordance with the present invention.

FIG. 3 illustrates a preferred embodiment for ribs 38' and 36' of both rotor 28 and the wall of the mixing channel 22, which according to the drawing are incontinuous so that both ribs 36' and 38' are cogged, either so that they are formed by a row of protrusions attached on the wall surface of the rotor/mixing channel or that they are formed of continuous ribs 36' and 38', which have protrusions and lower portions, in other words recesses therebetween. In another embodiment the protrusions of the counter surfaces are interlaced in such a way that said protrusions may, if as strong shear force field as possible is required, fit in the recess of the counter rib. In some cases it is preferable to arrange said ribs inclined and ascending relative to the axis, whereby they accelerate the pulp both tangentially and axially. This kind of alignment of ribs may, of course, be applied also to the continuous ribs shown in FIG. 1.

A substantial and important feature relative to the operation of the rotor is the length of the mixing portion, the mixing zone, in other words the length of the area, in which the pulp is subjected to such an amount of shear forces that the mixing is effective and uniform. The length of said area is affected by, for example, following:

volume of gas being mixed;

whether the reaction chemical, for example ozone, is desired to react practically speaking in the whole of said area;

energy consumption.

Of said features at least the second and third are counter features, because the reaction of ozone requires some time which again requires a long, energy-consuming mixing zone. It is the objective of the arrangement in accordance with our invention that the length of the mixing portion of the rotor 28 is as small as possible without risking the efficiency and uniformity of the mixing.

A substantial portion in the mixer in accordance with the present invention is a slowly tapering tip portion 40 of the rotor, preferably it may be of its shape "a reverse Laval-nozzle" or at least very much resembling it for two reasons. Firstly, if the chemical to be mixed is slowly reacting, for example oxygen, whereby the chemical-pulp mixture is to be fed subsequent to the mixing into a reaction vessel, said mixture must be supplied from the mixer to the vessel so that the large volume of fed gas does not separate, as in the prior art apparatuses, from the fiber suspension immediately subsequent to the mixing zone. Said alternative is discussed partially when describing FIG. 1 and especially FIGS. 4–6. Secondly, if the chemical to be mixed is rapidly reacting, as ozone is supposed to be at least according to some sources, the actual bleaching reaction takes place in the mixer itself, whereby the residual chemicals and/or the carrier gas may be separated from the mixture utilizing the mixer. Said alternative is discussed in connection with FIGS. 7 and 8.

In the embodiment of FIG. 1 a discharge channel 24 is conically widening, whereby as from an annular mixing zone/mixing channel 22 the flow channel steadily widens. The shape of the preferably vertical discharge channel 24 resembles a Laval-nozzle, in other words the walls are slightly curved of their cross-section, whereby the flow remains attached to the walls and does thus not cause separation of gas from the suspension. It is also possible to arrange the walls of the discharge channel 24 straight, in other words conical, whereby the total value determining the angle of the extension should preferably be below 8°. The purpose of the expansion of the flow channel when treating the mixture of slowly reacting chemicals and pulp is that the fluidized suspension having shear force fields forms fiber networks as quickly as possible, said fiber networks binding small gas bubbles therein before they have time to accumulate to larger bubbles or even to form a gas core in the center of the flow.

It is substantial for the dampening of the fluidization and the generation of the fiber networks to slow down the circumferential speed of the circulating flow generated by the rotor 28 in the mixing zone as quickly and efficiently as possible. For this purpose the surface of the tapering tip portion 40 of the rotor is in one of the embodiments polished very smooth, so as not to be able to generate any turbulence close to it or not to maintain the circulating movement of the pulp. In order to be able to slow down the speed of the flow quickly, the surface of the discharge channel 24 in FIG. 1 is provided with low ribs 42 (axially shown in the drawing) for stopping the circulating flow. As for the optimal operation of the apparatus, it is very important that said low ribs 42 are accurately directed so that they steadily turn the flow of the pulp circulating more or less in the direction of the rim gradually to an axial flow without generating turbulence to the surface layer of the suspension. Another requirement for the ribs is that, unless their direction is optimal, they may not generate turbulence in the surface layer, in other words pressure changes, which bring about separation of gas in the areas of lower pressure. In such a case decelerating ribs would have to be used that are very low at the first end. The height of the ribs is tended to keep so low that the ribs only prevent the circulation of the fiber layer accumulated on the surface of the flow channel thus facilitating the formation of the fiber network. When the circulating movement is stopped the direction of the flow changes gradually to axial, the fibers stick to each other and the fiber network begins to form. Then the height of the decelerating ribs may be slightly increased in accordance with FIG. 1, whereby a larger and larger portion of the fiber flow joins the fiber network quickly forming a plug flow. Of course, in some cases also axial ribs 42 may be used, as in FIG. 1, whereby the height of the ribs has to be determined more accurately than with the spirally wound ribs. The purpose of said embodiment of the present invention, which relates to mixing of slowly reacting chemicals, is to form the plug flow so quickly that especially the gaseous chemicals do not have time to accumulate as large bubbles, but they remain uniformly divided in the fiber network.

It must be noted that the mixing channel does not have to be defined by two cylindrical surfaces. It may, for example, be defined by two conical surfaces or one conical surface and one cylindrical surface. Also the direction of the taper of the cones may be either to the same direction or to opposite directions. An embodiment worth mentioning is a construction in which the sectional area of the surface of the mixing channel widens to the flow direction, whereby it is logical to arrange the outer wall of the channel to expand conically and to leave the rotor cylindrical from the mixing channel portion. It is, however, possible to arrange both members conical, and even at the same opening angle, whereby the increase of the cross-sectional area is caused by the mere increase of the radius of the channel. Of course, for example, the conicalness of the rotor, as well as that of the mixing channel itself, may be arranged to extend only to a portion of the length of the mixing channel. Also other than cylindrical and conical surface forms are possible, but their use is restricted by practical requirements in the manufacture. By arranging the mixing channel widening it is sometimes possible to leave the discharge channel cylindrical. This may also come into question, for example, in such cases when relatively small gas volumes are mixed into a dilute pulp at low rotational speed of the rotor, whereby the shear force field easily dampens merely by decreasing the cross-sectional area of the rotor in the discharge channel portion.

Figure 4A:
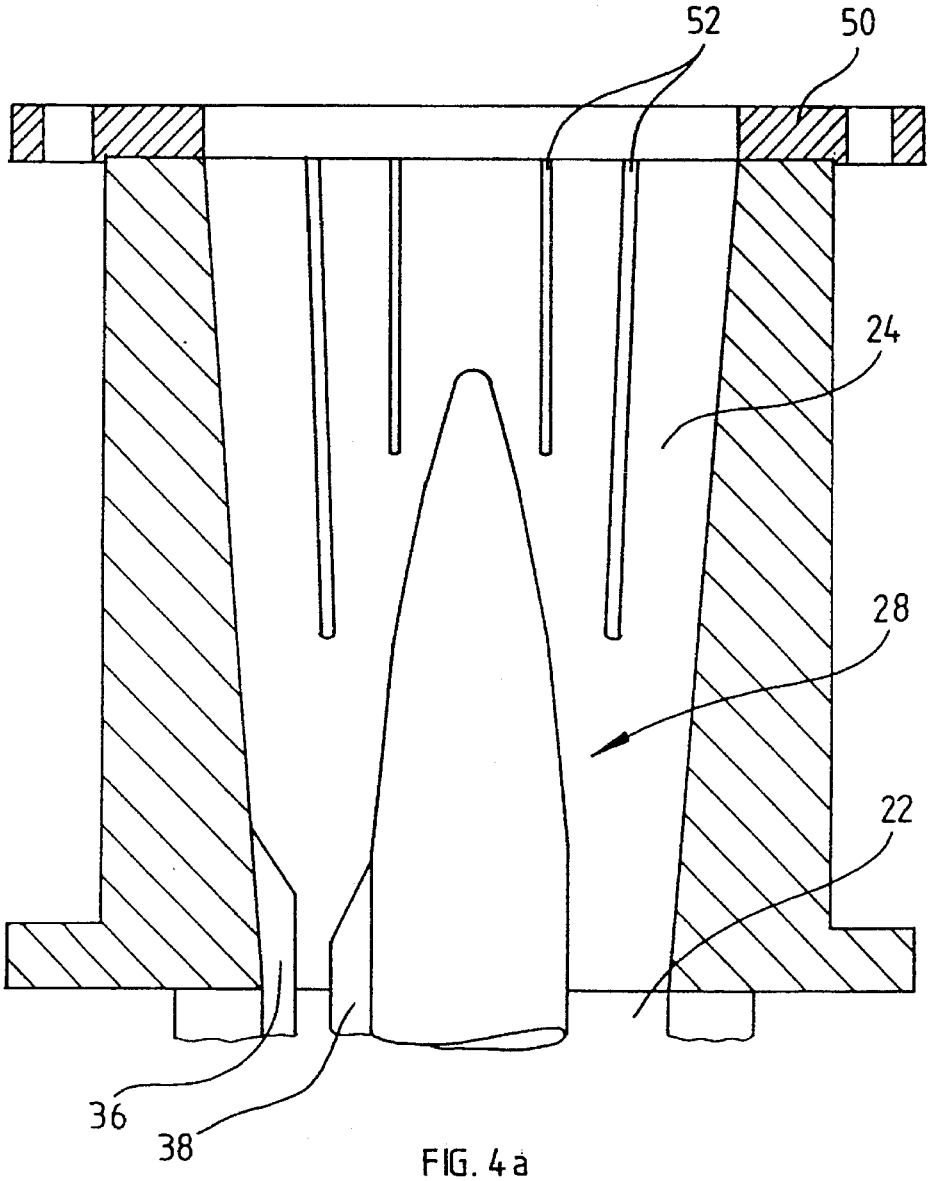
FIGS. 4*a* and 4*b* illustrate a detail in accordance with a preferred embodiment of the present invention.
Figure 4B:
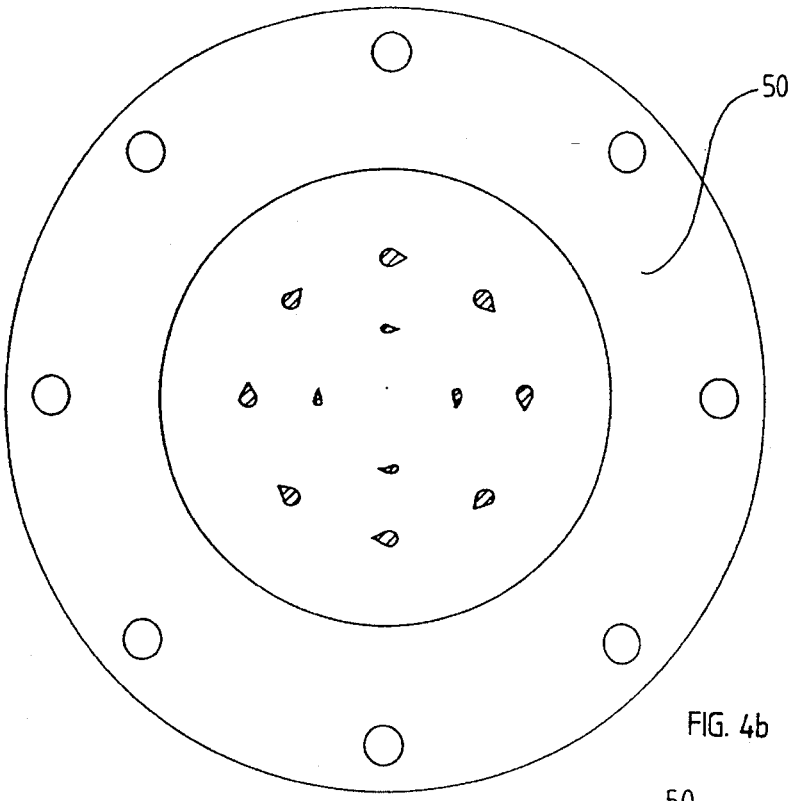

FIGS. 4*a* and 4*b* illustrate another way, alternative to ribs 42 on the wall of the flow channel, to decelerate the circulating movement of the fiber suspension in the discharge channel 24. Blade-like members 52 are arranged to the joint flange of the discharge channel 24 and a pipe attached thereto to extend towards mixing channel. The purpose of said members 52 is, of course, to decelerate the circulating movement of the pulp in the discharge channel so as to form a fiber network as quickly as possible. The members 52 must, however, be formed very carefully, so as to prevent the fiber suspension being discharged as a spiral flow from the mixing channel 22 from forming a vortex around the members, whereby a gas bubble would easily be formed as a result of a phenomenon corresponding to the cavitation/cavitating. FIG. 4*b* especially illustrates, how the blade-like members 52 in a preferred embodiment are located in the discharge channel 24. The drawing also illustrates a preferred cross-sectional form of the blades, which preferably does not form any pressure field around it to facilitate the separation of gas from the pulp. The direction of said members may either be substantially parallel to the direction of the axial flow in the discharge channel, curved in such a way that they turn the flow axially or also possibly bent in such a way that they are positioned always perpendicular to the circulating flow.

FIG. 4*a* yet discloses ribs 36 and ribs 38 of the rotor on the walls of the mixing channel. According to a preferred embodiment the ribs 38 of the rotor do not extend as far in the flow direction as the ribs 36. In other words, the effect of the rotor rotating the pulp may be terminated earlier, whereafter the circulating movement of the pulp in the mixing channel lasts some time to maintain the pulp in a fluidized state. At the same time the circulating movement slows down facilitating the deceleration of the circulating movement in the discharge channel. It has also been noted to be advantageous if the ends of the ribs are inclined, the height of the ribs decreasing to zero. The purpose thereof is to prevent the discharge of gas bubbles possibly accumulated behind the ribs, in other words to the so called lee side, full sized into the flow. By decreasing the height of the ribs the strongly turbulent pulp breaks the bubbles with the inclined edge of the rib, whereby the gas mixes better into the pulp.

Figure 5A:
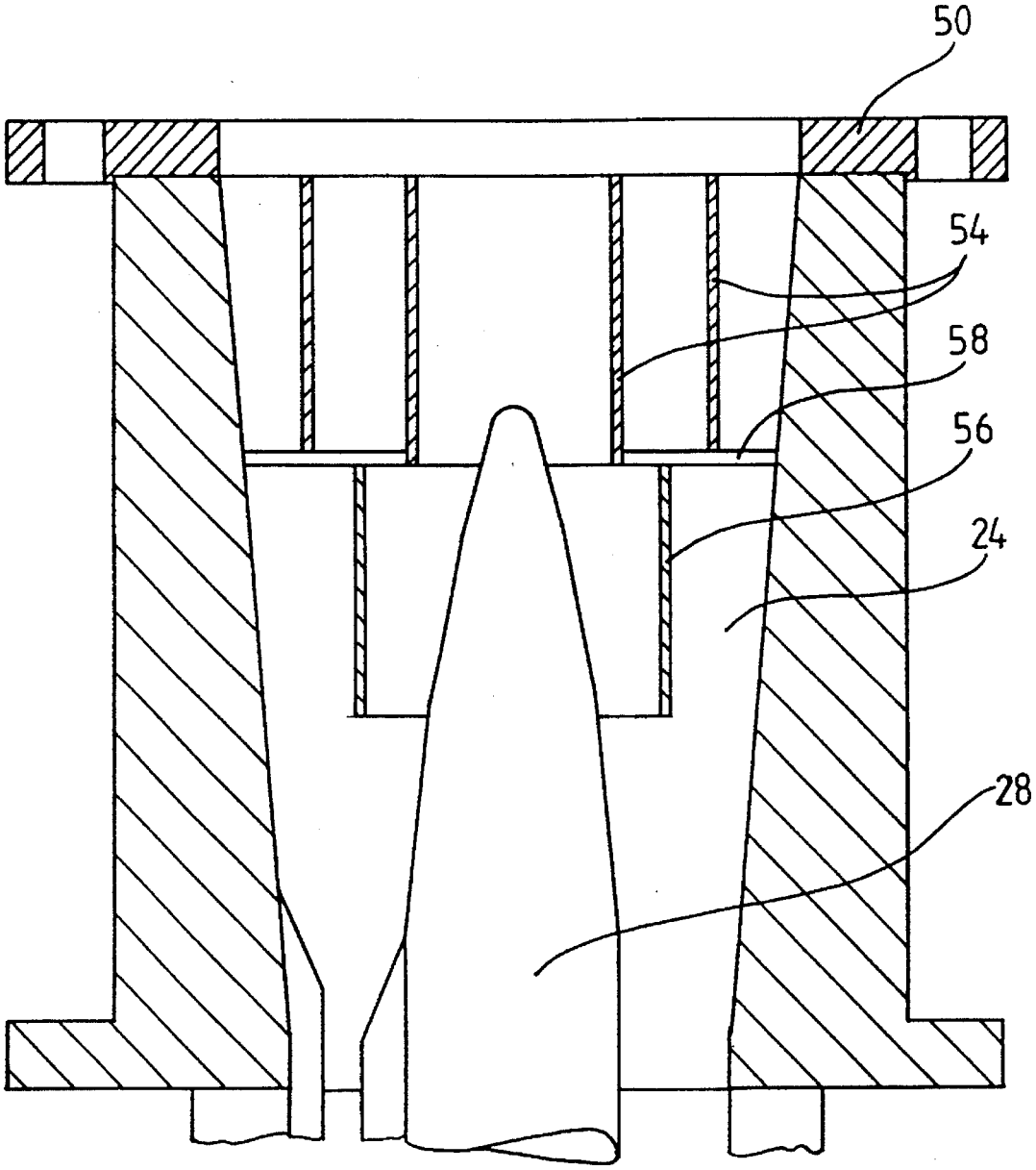
FIGS. 5*a* and 5*b* illustrate a detail in accordance with a second embodiment of the present invention.
Figure 5B:
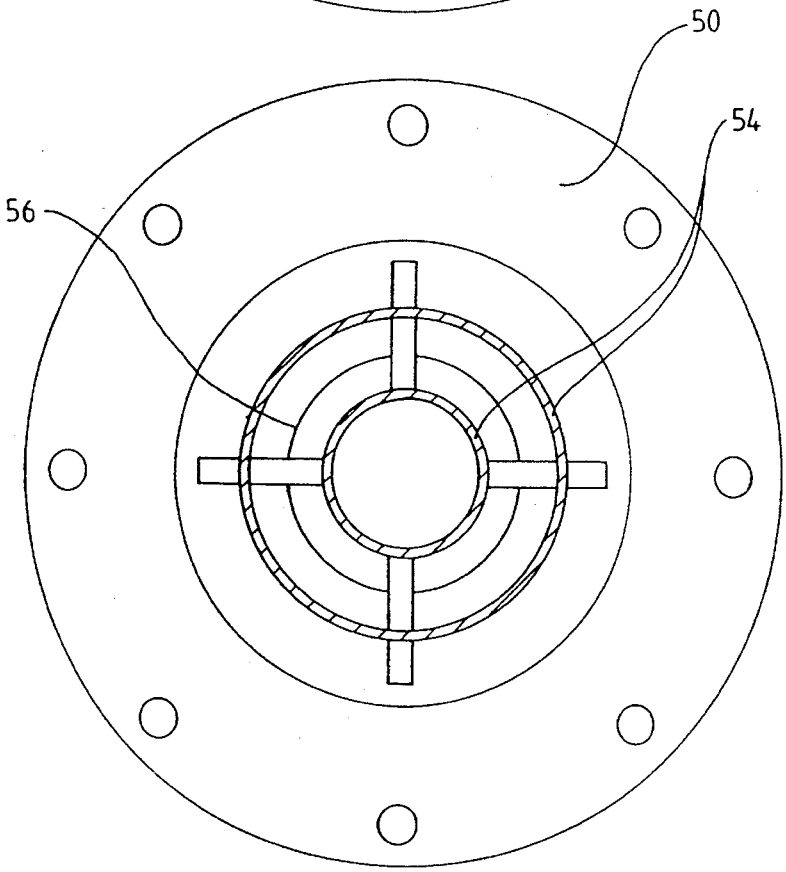

FIGS. 5*a* and 5*b* disclose a third alternative to increase friction surface in the area of the discharge channel 24. Members 54 and 56 formed of cylindrical or slightly conical surfaces are added in the embodiment of the drawing inside the discharge channel 24, the purpose of said members being only to increase the friction surface slowing down the circulating movement of the suspension, in other words generating a shear force field decelerating the circulating movement. Said surfaces may be arranged in the distance of 10 to 50 mm from each other, whereby their effect is most efficient as a decelerator of the circulating movement and a generator of a fiber network. In some cases it is possible to add in the middle of the members 54, 56 a stationary shaft to increase deceleration in the pulp circulating in the center of the discharge channel 24. The members 54, 56 are attached preferably from their wider edge to the joint flange 50 of the discharge channel 24. It is, of course, possible to support said members from their opposite ends to the wall of the discharge channel in order to eliminate a possible vibration, as is done by bars 58 in FIG. 6*a*. FIGS. 5*a* and 5*b* disclose a way of arranging said members 54 and 56 inside the discharge channel 24. It is, however, possible to arrange all members to begin from the same axial level either from the end of the rotor 28, prior or subsequent thereto. It is also possible to increase the distance of the members from each other in the discharge end also so that a number of the members do not extend as far as the others, for example, so that only every other member extends to the joint flange 50. It is also possible that said members 54 and 56 are not exactly rotationally symmetric, but are formed of slightly waved material, whereby their surface forms a considerably higher friction than the smooth cylinder or cone.

Figure 6:
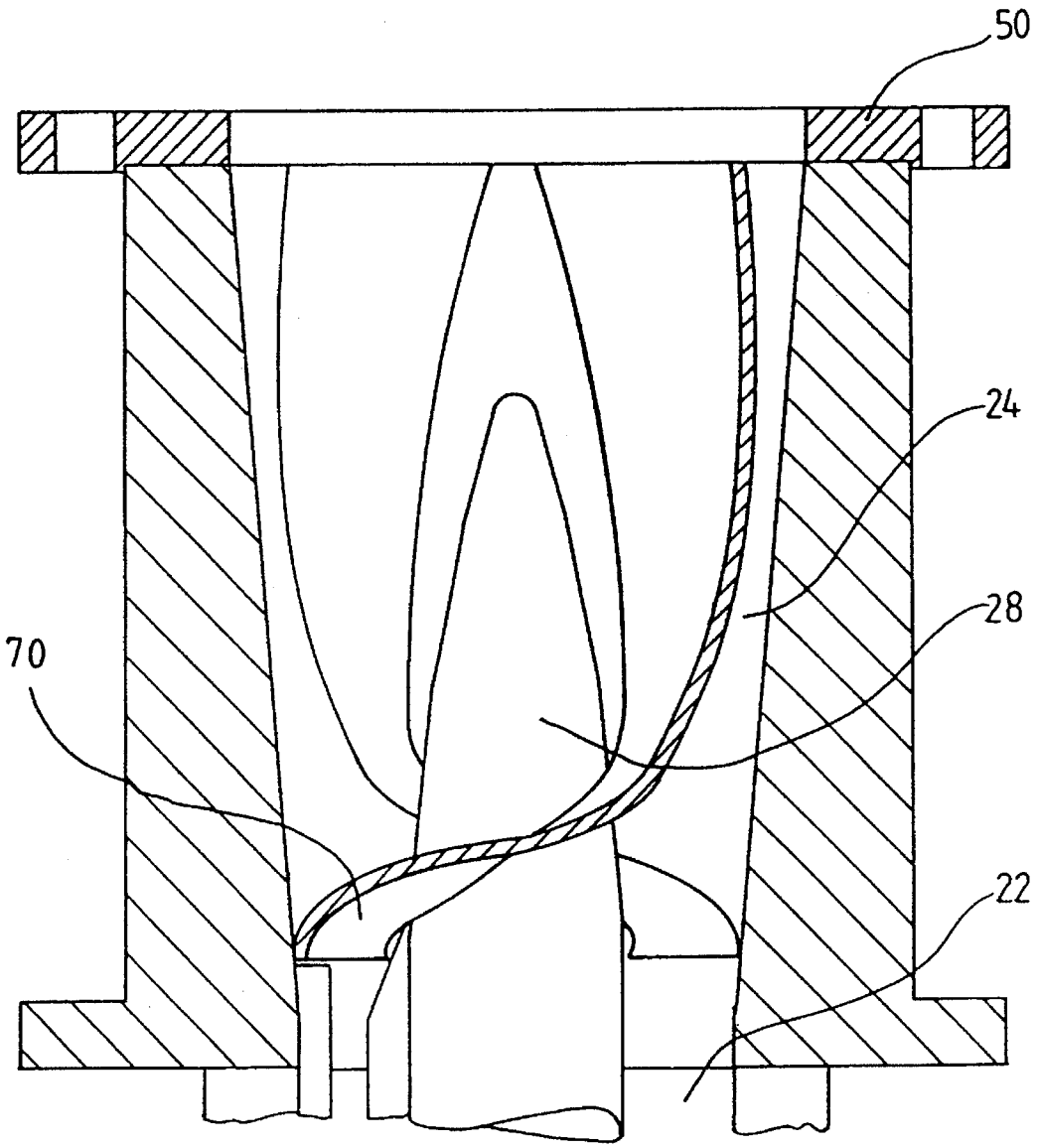
FIG. 6 illustrates a detail in accordance with a third embodiment of the present invention.

FIG. 6 discloses yet another efficient way of decelerating the circulating movement of the fiber suspension. The drawing relates to one of the embodiments, in which the flow direction is forced to change from parallel to the rim of the mixing channel to axial flow parallel to the pipe line subsequent to the mixer. Said change is brought about by arranging spiral strips or blades 70 at a slightly ascending angle of 4–10 grades from the first end of the discharge channel 24 or even prior to it to the wall of the discharge channel 24 (two strips placed opposite to each other shown). The rise of the spiral strips 70 is increased relatively quickly, whereby the movement parallel to the rim changes to axial. It is, of course, essential that the angle must be increased steadily and local lower pressure zones in the flow must be avoided. The number of the spiral strips also determines a successful deceleration of the flow. If the number of the spirals is very low, the rotational speed does not decelerate enough or the deceleration brings about local areas of lower pressure so that gas is allowed to separate from the flow. In the performed experiments it has been noted that the number of the spiral strips should vary between 3 to 10 according to the diameter of the discharge channel and also according to the rotational speed of the rotor and the volume of gas and consistency of the pulp.

Yet another way of decelerating the rotional movement of the suspension flowing from the mixing channel is to arrange one or more plates with openings perpendicular to the shaft or at least in an angled position relative to the axial direction in the discharge channel, whereby the kinetic speed of the suspension parallel to the rim quickly slows down when flowing through the openings.

Figure 7:
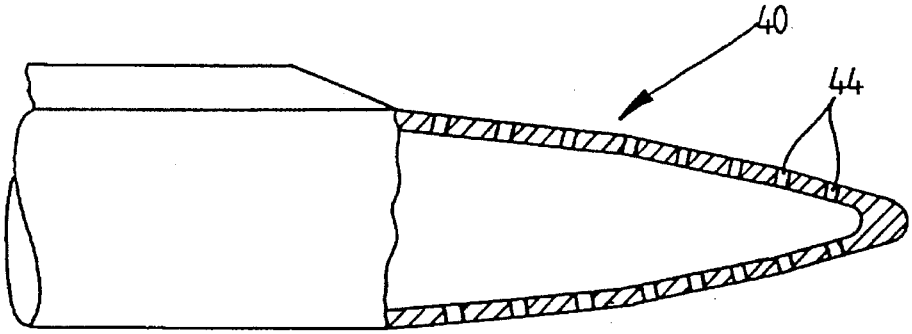
FIG. 7 illustrates a rotor in accordance with a preferred embodiment of the invention.

It is a characterizing feature of another embodiment of the present invention primarily relating to the mixing of rapidly reacting chemicals, the reaction thereof in the mixer and the discharge of residual chemicals/gases and/or carrier gases from the mixer, illustrated in FIG. 7, that the tip portion 40 of the rotor is provided with gas discharge openings 44, through which excessive gas in the fiber suspension may be drawn or guided away. In some cases it is also possible to perforate a portion of the rotor surface 28 in the mixing channel area to intensify the discharge of gas. Said portion locates at the discharge end of the mixing channel. The illustrated embodiment may be applied, for example, in ozone bleaching, in which a mixture of ozone and carrier gas is mixed into the pulp, whereby at least the carrier gas or a portion thereof may be separated already in the tip area of the rotor. Also the excessive volume of ozone may be removed by utilizing the embodiment of the drawing, if the reaction time of ozone is considered to be sufficient in the mixing zone. Gas in the illustrated embodiment is led beforehand from the interior of the rotor 28 in a manner known per se, for example, through the gas-separating centrifugal pumps along the shaft of the rotor either to further treatment, cleaning or to be utilized, for example, in some other bleaching stage. It is also a characterizing feature of the above-mentioned embodiment of said construction alternative using ozone that the flow speed of the fiber suspension in the mixing zone is appropriate to the ozone, which is the chemical to be supplied, to react properly with the fiber suspension in the mixing zone. When practically speaking all of the ozone has reacted, the gas that is left, being mainly carrier gas, may be removed through the tip portion of the rotor as efficiently as possible. In the arrangement in accordance with said embodiment, the smoothness of the surface of the rotor is not important. It is actually better for the gas separation that the surface of the rotor is at least to some extent uneven, rough or even provided with small blades, ribs or like.

Figure 8A:
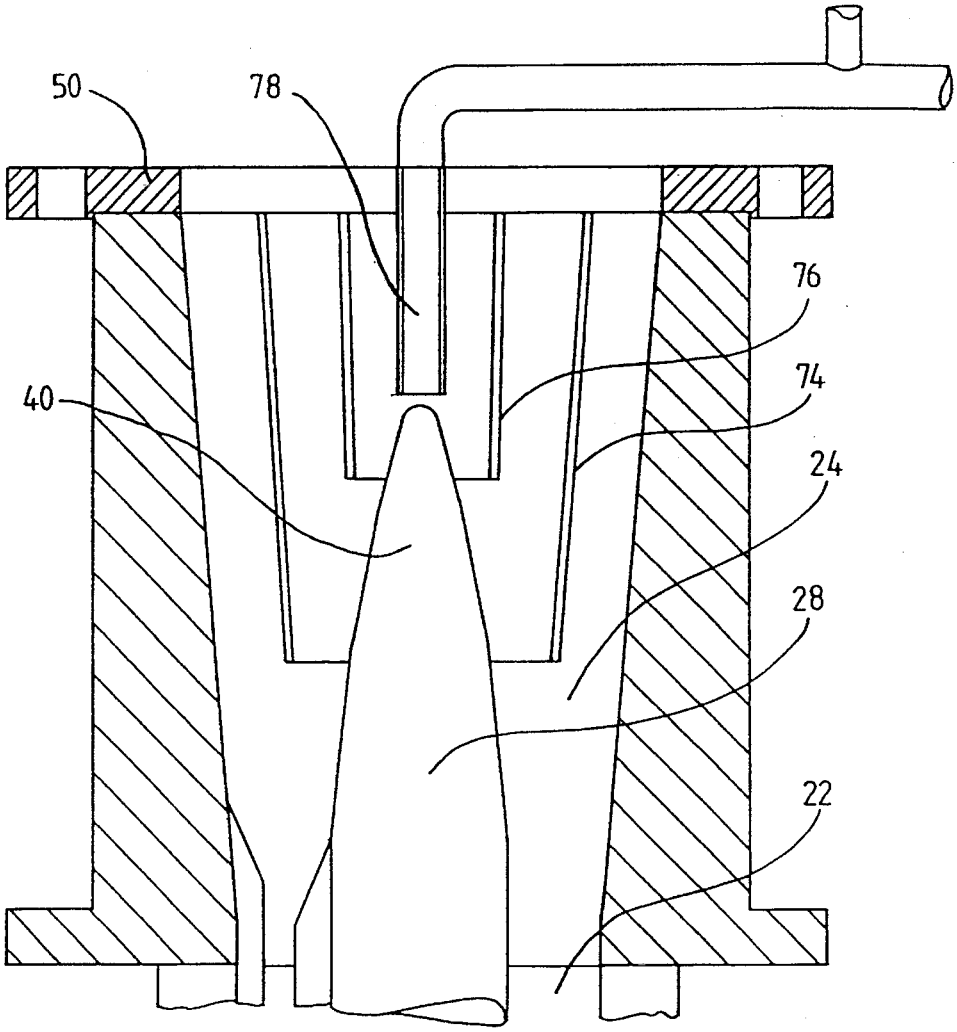
FIGS. 8*a*–8*d* illustrate arrangements in accordance with preferred embodiments of the present invention.
Figure 8D:
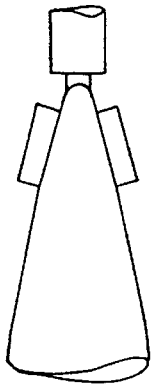
Figure 8C:
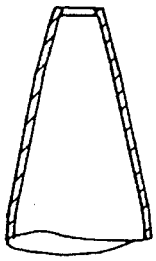
Figure 8B:
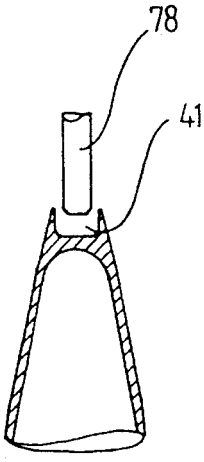

FIGS. 8*a*, 8*b*, 8*c*, and 8*d* disclose an apparatus in accordance with a preferred embodiment of the present invention more in detail. The drawings illustrate in a way the rotationally symmetric deceleration members already described in connection with FIGS. 5*a* and 5*b*, which are here referred to as 74 and 76. In said embodiment a pipe 78 with a relatively small diameter is mounted in the middle of said members, extending right from the tip portion of the rotor 28 to the joint flange 50 and further to the outside of the apparatus. Moreover, the tip portion 40 of the rotor does not have to be polished anymore, but rough to some extent, as was described in connection with the description relating to the previous drawing. The purpose of the rotor is first of all to generate with the tip portion 40 some turbulence around the rotor so that gas tends to separate as a thin layer therearound. Therefrom the gas flows further towards the tip of the rotor to the area of the smallest diameter, wherefrom it is discharged along pipe 78. The pipe 78 is, when required, connected to a vacuum source or to some other appropriate apparatus (not shown). The objective of this embodiment is to enable a rapid bleaching so that a gaseous chemical is led by the rotor 28 to a fluidized pulp layer, allowed to flow through said layer and to react with the lignin of the fibers and the residual gas is separated by the tip portion 40 of the rotor. At this stage and depending on the reaction speed of the chemical also the displacement bleaching described above may come into question. The apparatus operates, for example, in such a way that when gas accumulates forming a bubble around the tip portion of the rotor it rises as the lightest to the pipe and fills the pipe 78. By adjusting the volume of gas being discharged from the pipe the fibers may be prevented from flowing in to the pipe 78. A way (FIG. 8*b*) to complicate the flow of the fibers to the pipe 78 is to provide the tip portion of the rotor with an open portion or with an axial recess 41, which of course is filled with gas, because the relatively high axial flow speed of the fiber suspension carries the suspension past the recess and the fiber suspension is also affected by a considerably strong centrifugal force, which is due to the rotational speed. FIG. 8*c* yet illustrates a way of discharging gas from the top of the rotor. The top of the rotor 28 is provided with an opening for leading the gas into the rotor and out therefrom via a known route. FIG. 8*d* illustrates yet a way of generating a local shear force field to the top of the rotor intensifying the gas separation, by mounting small blades, ribs or like to said tip area. By combining said embodiment, for example, with the deceleration members shown in FIG. 8*a* an embodiment is obtained, in which a fiber network is allowed to be formed of the suspension in the outer layers of the discharge channel, but gas is intentionally separated from the inner flow layer.

Besides the embodiments shown in the drawing, also other arrangements are possible in the separation of gas. It is possible to cut the rotor so that the tip thereof remains blunt, whereby gas is easily separated to the discharge side of the rotor. If required blades mounted as an extension to the rotor to intensify the circulating movement of the pulp may be used to intensify the gas separation.

Figure 9A:
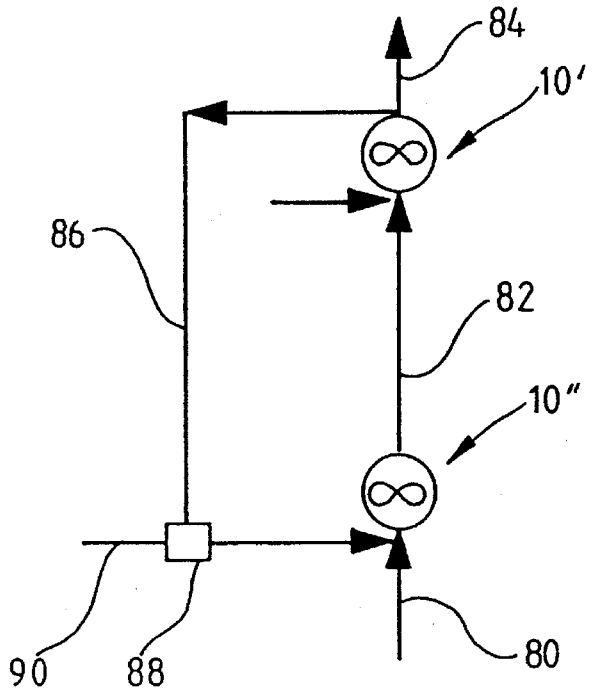
FIGS. 9*a* and 9*b* illustrate two preferred applications of the method and apparatus in accordance with the present invention for a bleaching process.
Figure 9B:
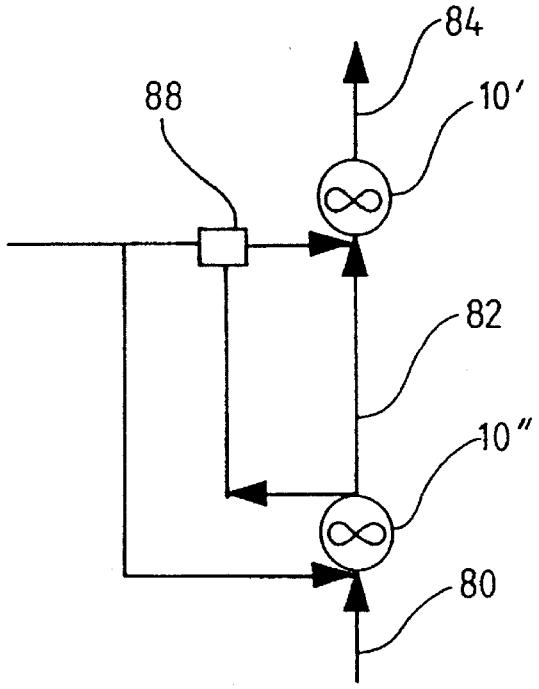

FIGS. 9*a* and 9*b* illustrate two preferred applications of an apparatus and a mixing method in accordance with the present application. In FIG. 9*a* two mixers 10' and 10" in accordance with the present invention are connected in series in such a way that the pulp to be treated is introduced via a flow channel 80 into the mixer 10", led therefrom via a flow channel 82 into the mixer 10' and discharged therefrom to a pipe line 84. According to an embodiment at least the mixer 10' is preferably either similar to FIG. 7 or FIG. 8 (shown here). In other words a rapid bleaching is carried out in the mixer 10' as previously described in FIG. 7 and the separated residual gas is removed along a flow channel 86 from the mixer 10' and also from the so called second bleaching step. The gas is brought along the flow channel 86, for example, to a venturi-pipe-type mixer 88, in which the residual gas is drawn into and mixed with fresh bleaching chemical arriving along a flow channel 90 to the second mixer 10" and further introduced into the mixer 10". If so desired or required, the second mixer 10" may be a gas-separating mixer, whereby the residual gas is further to be led to one of the further treatment or further utilization stage. It is characteristic of the described process that the volume of gas to be introduced into the mixer 10' second in the flow direction of the fiber suspension is greater than the volume of gas to be supplied to the mixer 10" first in the flow direction. As can be seen, the process in question is a so called counter current bleaching, in which a mixture of "clean" bleaching chemical and a "used" chemical removed from the second bleaching step is supplied to the first bleaching step, in other words to the mixer 10", whereby, of course, the amount of active chemical in the first stage is smaller. "Clean and non-used", fresh chemical is again fed to the second step.

FIG. 9*b* discloses a reverse bleaching process, in which fresh chemical is fed to the first mixer 10" and the residual gas, which is separated subsequent to the mixer 10" or in the mixer is mixed with fresh chemical and fed into the pulp in the mixer 10' of the second step.

Of course, it is possible that more bleaching steps of said type are arranged subsequently, whereby the return of the residual gas may also be arranged either only to the first step or always to the step preceding the removal or possibly also to the last step or the step following the removal. The way how this is done, depends on the amount of chemical fed to each step, the chemical contents, the chemical being fed as "fresh", etc.

Figure 10:
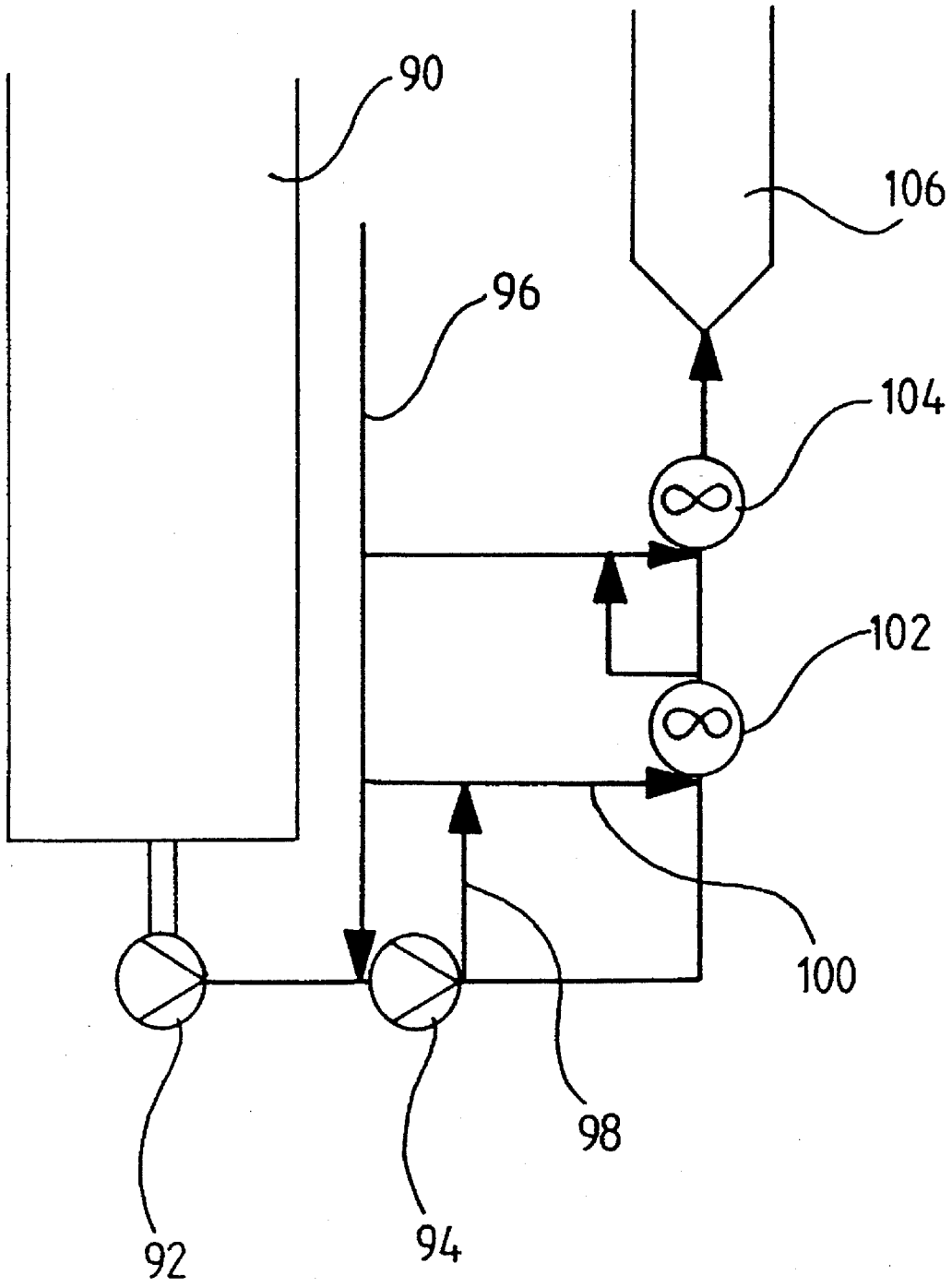
FIG. 10 illustrates yet another application of the method and apparatus in accordance with the present invention for a bleaching process.

FIG. 10 yet illustrates a process within the scope of the present invention. Number 90 refers to a conventional mass tower, which as such may be a bleaching or storage tower, from which the medium or high consistency pulp is preferably supplied by a fluidizing centrifugal pump 92 to a second fluidizing centrifugal pump 94 provided with a gas discharge and to the suction side of which in the effective range of the fluidizer the bleaching chemical is fed from the pipe 96. Residual gas, consisting either completely of a bleaching chemical or, for example, when ozone is used, of both the bleaching chemical and a so called carrier gas, is separated in the pump 94. The separated gas is led via a pipe 98 into an inlet pipe 100, for example, as described in the previous embodiment. The chemical mixture from the pipe 100 is fed to a mixer 102, which may be a mixer in accordance with the present invention separating gas. The gas to be separated is led from the mixer 102 in a previously known manner to another mixer 104, from which the pulp to be treated is discharged to a vessel 106, in which the bleaching chemicals are allowed to completely react. It is worth noting that the above described embodiment is completely exemplary. The basic idea is that now for the first time in the history a centrifugal pump is suggested to be used not only to mix a chemical to a pulp, but also to act as a "bleaching vessel" so that the ability of the centrifugal pump to separate large volumes of gas from pulp is utilized to separate the residual gas from the pulp. At the same point, as an alternative, bleaching can be carried out in three subsequent mixers, as three step bleaching. Further, alternatively, pulp is fed to the fluidizing centrifugal pump 94 operating as a gas separator by another fluidizing centrifugal pump 92, whereby the pressure in the feed of the pump 94 facilitates the separation of the gas from the pulp.

Moreover, a method worth mentioning is to bleach pulp more efficiently than before by ozone. As mentioned earlier, ozone may be used due to practical reasons only in relatively low consistencies (5–10%). It has been, however, noted that due to an efficient, rapid and uniform mixing it is possible to use also higher ozone contents in the mixer in accordance with the present invention. Such is achieved by adding a semi-permeable membrane into communication with said porous surface, by means of which the ozone may partially be separated from the carrier gas. Thus greater ozone contents are obtained to the mixing zone, which leads to a considerably more efficient bleaching result.

Except for said ceramic, sintered or finely perforated gas feed rings it is possible to use in the gas feed quite a different technique. The gas inlet rings are provided with relatively large holes having a diameter of 1–3 mm, of which gas is injected in thin sharp jets to the pulp circulating in the mixing zone. By using said technique it is possible to achieve a more efficient penetration of gas into the pulp and the flow-through of gas from the pulp layer is accelerated.

As for the ozone bleaching, yet a method worth mentioning is to improve the total economy of the system. It is known that the ozone is generally manufactured in atmosperic conditions or slightly pressurized from oxygen, which is brought to the mill in a pressurized form. Immediately prior to the bleaching, in other words the feed to the mixer, the pressure of the ozone (and the carrier gas) is raised to 7–15 bar by an expensive compressor. It has been noted, however, that it is completely possible to manufacture ozone in pressurized conditions from pressurized oxygen so that the obtained ozone remains pressurized throughout from the manufacture to the mixing, whereby said compressor is not necessary.

As seen above a new kind of a method and apparatus for mixing gas into a medium and a bleaching process applying the method are developed. Although several different apparatus variations are disclosed above, they are only meant to exemplify and clarify without any intention to restrict from what is given in the patent claims, which alone determine the scope of invention. Thus also many other alternatives are within the scope of invention. The above description also concentrates on the bleaching process and especially a bleaching process that uses ozone. However, the method and apparatus may as well be applied for mixing of gaseous chemicals or additives and also of liquid chemicals or additives. As for the detailed bleaching process described above also other bleaching processes may come into question. It is, for example, logical that the residual gas from one mixer may be led entirely to another bleaching step and not necessarily to the preceding or subsequent bleaching step as in the above described example. It is also possible that the oxygen to be separated as residual gas from the ozone bleaching is led to an oxygen bleaching stage or step and not mixed with a high ozone-containing gas.

What is claimed is:

1. A method of mixing gas with a suspension of cellulose fibers having a consistency of about 10–18%, comprising the steps of:

(a) while the suspension of cellulose fibers having a consistency of about 10–18% is moving in a first direction, subjecting the suspension to an intense shear force field to fluidize the suspension;

(b) while practicing step (a), introducing gas to be mixed with the suspension into the moving fluidized suspension so that the gas and suspension mix substantially uniformly; and (c) immediately after the gas and suspension have uniformly mixed together during the practice of step (b) while the suspension is moving in the first direction, positively dampening the shear force field so that the suspension assumes plug flow, so that the gas remains substantially uniformly mixed with the suspension.

2. A method as recited in claim 1 wherein step (b) is practiced to introduce gas at a rate such that the introduced gas during the practice of step (b) is between 20–60% of the total volume of gas and suspension.

3. A method as recited in claim 1 wherein step (b) is practiced by introducing the gas into the suspension so that the gas forms small bubbles, by forcing the gas through a gas-porous solid.

4. A method as recited in claim 1 wherein step (a) is practiced to cause the suspension to flow in an annulus; and wherein step (b) is practiced by introducing the gas in thin sharp jets flowing substantially perpendicular to the first direction so that the gas immediately penetrates the suspension in the annulus.

5. A method as recited in claim 1 wherein step (b) is practiced by introducing cellulosic fiber bleaching gas having a primary bleaching agent, and containing ozone gas as the primary bleaching agent.

6. A method as recited in claim 5 wherein step (b) is practiced by introducing the gas so that it flows into the suspension in a direction substantially perpendicular to the first direction.

7. A method as recited in claim 5 wherein step (b) is practiced to introduce gas at a rate such that the introduced gas during the practice of step (b) is between about 30–50% of the total volume of suspension and gas.

8. A method as recited in claim 5 comprising the further step of, during the practice of step (c), immediately withdrawing from the suspension any gas that separates from the suspension.

9. A method as recited in claim 1 wherein step (a) is practiced by imparting a rotating movement to the suspension substantially centered about an axis which extends substantially in the first direction.

10. A method as recited in claim 9 wherein step (c) is practiced by transforming the rotating movement of the suspension into movement substantially in the first direction.

11. A method as recited in claim 10 wherein step (c) is practiced by providing physical obstructions to rotating movement of the suspension which extend substantially in the first direction to guide flow of the suspension in the first direction.

12. A method as recited in claim 9 wherein step (c) is practiced by subjecting the suspension to a decelerating shear force field which transforms the rotating suspension flow into flow substantially in the first direction.

13. A method as recited in claim 12 wherein step (c) is further practiced by subjecting the suspension to a plurality of decelerating shear force fields.

14. A method as recited in claim 13 wherein step (c) is further practiced by subjecting the suspension to the plurality of decelerating shear force fields in sequence.

15. A method as recited in claim 13 wherein step (c) is further practiced by subjecting the suspension to a plurality of decelerating shear force fields, one within another, at substantially the same time.

16. A method of bleaching cellulose fiber suspension having a consistency of about 10–18%, comprising the steps of:

(a) fluidizing the cellulose fiber suspension having a consistency of about 10–18% in an annulus;

(b) while the suspension is fluidized, adding a gaseous bleaching agent to the suspension;

(c) effecting uniform mixing of the gaseous bleaching agent and the cellulose fibers of the suspension to effect reaction therebetween by further agitating the suspension while the gaseous bleaching agent is in contact therewith;

(d) after step (c) discharging the suspension from the annulus; and (e) removing gas that separates from the suspension substantially contemporaneously with, or substantially immediately after, step (d).

17. A method as recited in claim 16 wherein step (b) is practiced by introducing gas containing ozone as the primary bleaching agent.

18. A method as recited in claim 16 wherein step (b) is practiced by introducing gas containing ozone as substantially the only effective bleaching agent, step (b) being practiced to introduce gas at a rate such that the introduced gas during the practice of step (b) is between 20–60% of the total volume of gas and suspension.

19. A method as recited in claim 16 wherein step (b) is practiced by causing the gas to flow radially through a gas-permeable solid into the mixing channel.

20. A method as recited in claim 16 wherein steps (a) through (e) are practiced at a first location; and comprising the further steps of subjecting the suspension discharged in step (d) to steps (a) through (d) at a second location remote from the first location, using as a gaseous bleaching agent in the practice of step (b) at the second location gas removed during the practice of step (e).

21. A method as recited in claim 20 wherein step (b) at the second location is further practiced by adding additional gaseous bleaching agent thereto.

22. A method as recited in claim 20 comprising the further steps of: also practicing step (e) at the second location; subjecting the suspension discharged in step (d) at the second location to steps (a) through (d) at a third location remote from the first and second locations, using as a gaseous bleaching agent in the practice of step (b) at the third location gas removed during the practice of step (e) at the second location.

23. A mixer for mixing gas into a suspension, comprising:

a mixer body including an interior and an exterior;

a rotor disposed in said mixer body and rotatable therein about an axis of rotation;

said mixer body interior and said rotor defining a substantially annular mixing channel therebetween, said mixing channel having a discharge end;

a suspension inlet to said mixer body and a suspension outlet from said mixer body, said suspension inlet and outlet being axially spaced from each other along said axis of rotation of said rotor;

a gas inlet to said mixing channel; and said rotor comprising a first end remote from said suspension outlet, and a second end closer to said suspension outlet than sad first end, said second end tapering gradually inwardly from said mixing channel discharge end toward said suspension outlet.

24. A mixer as recited in claim 23 wherein said mixer body interior tapers outwardly from said rotor second end.

25. A mixer as recited in claim 23 further comprising ribs on said rotor extending into said substantially annular mixing channel along the majority of the axial length of said mixing channel.

26. A mixer as recited in claim 23 further comprising substantially axially extending blades disposed in said mixer body adjacent said suspension outlet and said rotor send end.

27. A mixer as recited in claim 23 further comprising a plurality of ribs radially upstanding from said mixer body interior between adjacent said mixer body suspension outlet and at least a portion of said rotor second end.

28. A mixer as recited in claim 23 further comprising a plurality of tubular substantially cylindrical or conical elements disposed in said interior of said mixer body in the volume thereof between said mixing channel and said suspension outlet, and at least a portion of one of said tubular elements surrounding said rotor second end.

29. A mixer as recited in claim 23 further comprising at least one spiral strip disposed in the mixer body interior between said mixing channel and said suspension outlet and positioned and constructed to impart shear force deceleration to material flowing from said mixing channel toward said suspension outlet.

30. A mixer as recited in claim 23 wherein said rotor second end has a tip; and further comprising means for removing gas that separates from material flowing in said mixer body interior adjacent said rotor second end tip from the mixer body interior.

31. A mixer as recited in claim 23 wherein said rotor is at least partially hollow.

32. A mixer as recited in claim 31 wherein said tapering second end of said rotor is perforated to allow gas which separates from suspension adjacent said rotor second end to pass into a hollow portion of said rotor.

33. A method of bleaching medium consistency cellulose pulp utilizing a gaseous bleaching agent and a fluidizing centrifugal pump having a suction channel, comprising the steps of:

(a) pumping the medium consistency pulp with the fluidizing centrifugal pump;

(b) feeding gaseous bleaching chemical into the suction channel of the fluidizing centrifugal pump as it is pumping pulp;

(c) causing the gaseous bleaching chemical to react with the pulp in the centrifugal pump to effect bleaching;

(d) removing any residual gas from the pulp in the centrifugal pump;

(e) mixing the removed residual gas from step (d) with fresh gaseous bleaching chemical; and (f) using the mixture of separated residual gas and fresh bleaching agent to effect bleaching of pulp at a second location.

* * * * *